United States Patent [19]

Brandeau et al.

[11] 4,225,207

[45] Sep. 30, 1980

[54] CONVERTIBLE CABLE-CONNECTOR ASSEMBLY

[75] Inventors: Edward P. Brandeau, Willimantic, Conn.; John M. Gentry, Asheville, N.C.

[73] Assignee: Akzona Incorporated, Asheville, N.C.

[21] Appl. No.: 25,283

[22] Filed: Mar. 29, 1979

[51] Int. Cl.[3] ..... H01R 4/10

[52] U.S. Cl. ..... 339/95 R; 339/176 MF; 339/210 M; 339/276 T

[58] Field of Search ..... 339/97 R, 97 P, 98, 339/99 R, 275 R, 275 C, 275 T, 276 R, 276 C, 276 F, 276 S, 276 T

[56] References Cited

U.S. PATENT DOCUMENTS

| | | | |
|---|---|---|---|
| 3,405,385 | 10/1968 | Rapp | 339/97 R |
| 3,511,921 | 5/1970 | Pasternak | 339/98 |
| 4,065,850 | 1/1978 | Burr | 339/97 R |
| 4,106,838 | 8/1978 | Jayne et al. | 339/99 R |
| 4,173,388 | 11/1979 | Brandeau | 339/276 T |

FOREIGN PATENT DOCUMENTS

| | | | |
|---|---|---|---|
| 2729680 | 8/1978 | Fed. Rep. of Germany | 339/97 P |
| 1076628 | 7/1967 | United Kingdom | 339/99 R |

*Primary Examiner*—John McQuade

*Attorney, Agent, or Firm*—Leydig, Voit, Osann, Mayer & Holt, Ltd.

[57] ABSTRACT

A cable-connector assembly comprising a housing with a double array of pin sockets having plate members, an intermediate ground bus plate member, a cable locked in the housing and having a plurality of wires spaced in a plane, and all of the plate members being slotted to a width somewhat narrower than one of the wires, the ends of the wires being forced longitudinally into respective ones of the slots without lateral spreading of the wires. Vertical movement of the wires into the slots is facilitated by the plate member portions defining the outer ends of the slots being bent to define tapered wire guides. The assembly is convertible in the sense that a second cable providing additional ground wires may be locked in the housing and attached to a second bus plate with the wires forced into slots in the second bus plate.

2 Claims, 6 Drawing Figures

CONVERTIBLE CABLE-CONNECTOR ASSEMBLY

This invention relates generally to electrical connector-cable assemblies and more particularly concerns a convertible connector assembly for handling one or two cables.

In telephone communication systems, flat multi-wire cables are often used to carry signals to and from printed circuit boards. A typical cable of this type includes 31 wires, 16 signal wires separated by 15 shield or ground wires. Often, when additional shielding is desired, two such flat cables are run side-by-side with the 31 wires of the second cable being all connected as ground wires. This acts to surround each signal wire on three sides with ground wires.

Considering that a typical cable has the wires spaced on 1/32" centers, and that typical communication system circuit boards have connecting pins on $\frac{5}{8}$" centers, a double cable as referred to above brings 62 wires to a termination point in a band only about 1" wide and requires connecting 16 of those wires to separate signal pins on $\frac{5}{8}$" centers as well as requiring ground connections for the others. This is a very high wire density.

A particularly effective and economical technique of making such dense electrical terminations is shown in U.S. Pat. No. 4,173,388, issued Nov. 6, 1979. It is the primary aim of the present invention to introduce improvements in that general technique and adapt the result to a novel cable-connector assembly for dense, double cable terminations of the kind referred to above.

A related object of the invention is to provide a cable-connector assembly of the foregoing type that is convertible in the sense that the same connector, and the associated tooling for making the connections, can be used for terminating either a single cable or a double cable.

In one of its details, it is an object to provide, for an assembly as characterized above, a termination configuration that facilitates proper mating of a wire and the termination strip, particularly when a single direction, vertical connecting force is utilized to make the connection.

A further object is to provide an assembly as described above in which the wires need not be fanned out in the plane of the cable in a precise pattern to make the terminations, but rather the necessary spreading is done out of the plane of the cable as an inherent result of the termination operation.

Other objects and advantages of the invention will become apparent upon reading the following detailed description and upon reference to the drawings, in which.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Figure 1:
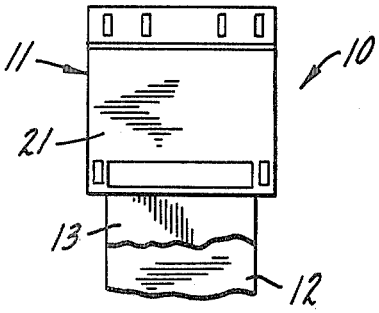
FIG. 1 is a plan view of the ends of a double cable-connector assembly embodying the invention.
Figure 2:
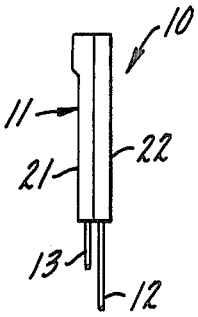
FIG. 2 is a side elevation of the cable-connector assembly as shown in FIG. 1.
Figure 3:
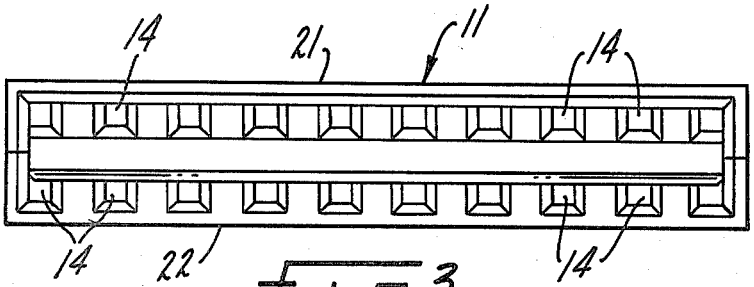
FIG. 3 is an enlarged end view of the connector shown in FIGS. 1 and 2.
Figure 6:
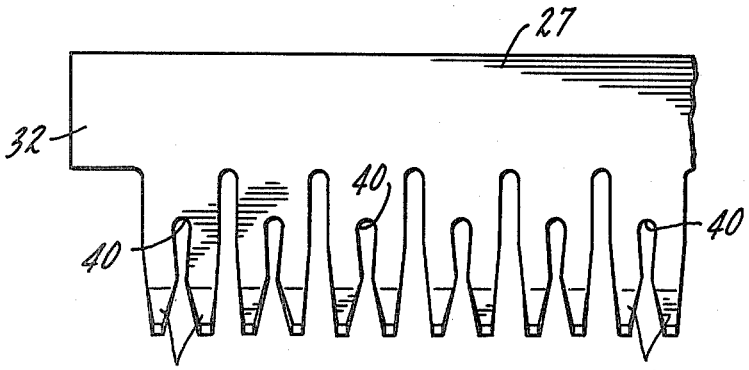
FIG. 6 is a fragmentary plan of one of the elements making up the connector otherwise shown in FIG. 4.
Figure 5:
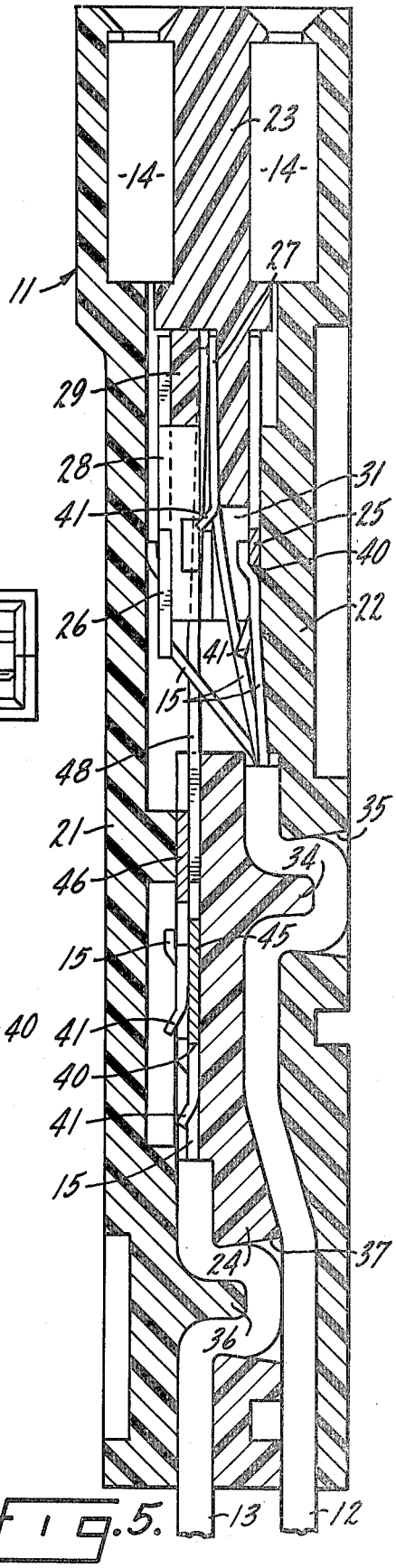
FIG. 5 is a section taken approximately along the line 5—5 in FIG. 4.

Turning to FIGS. 1 and 2, there is shown an assembly 10 embodying the invention and including a connector 11 within which a pair of flat cables 12 and 13 are terminated. In the illustrated embodiment, the cables 12, 13 include thirty-one wires 15, each positioned side-by-side on 1/32" centers with the upper cable 13 being solely a ground cable and the lower cable 12 having sixteen signal wires separated by fifteen ground wires. The connector 11 includes an upper and lower array, upper and lower as seen from the right-hand side of FIGS. 2 and 5, of ten sockets 14 in each array, on 1/8" centers, with the two end sockets 14 at each end of the two arrays being the ground wire sockets. In some cases, a second ground cable is not required and, in that case, the cable 13 is simply eliminated and the rest of the assembly remains the same.

The illustrated connector 11 includes upper and lower housing halves 21 and 22, respectively, and front and rear housing blocks 23 and 24, respectively. The sockets 14 include longitudinal pin-receiving bodies fitted in recesses between the front housing block 23 and the upper and lower housing halves 21, 22. The bodies of the sockets 14 are extended to plate members 25 in the case of the lower row of sockets, and 26 in the case of the upper row of sockets, except for the bodies of the four end sockets, and the plate members 25, 26 are disposed in two parallel planes. A ground bus plate member 27 is disposed in the housing of the connector 11 intermediate and parallel to the planes of the plate members 25, 26.

To support the plate members for wire termination, the plate members 25 of the lower row of sockets rest on a flat inner surface of the lower housing half 22, the ground bus plate member 27 rests on a flat surface of the front housing block 23, and the plate members 26 of the upper row of sockets 14 rest on laterally spaced arms 28 extending from a spacer 29. The spacer arms 28 underlie every fourth wire 15 of the cable 12 and provide clearance between them for the intermediate three wires. The front housing block 23 has spaced finger portions 31 underlying the ends of the arms 28 so that there is solid support for the arms to the lower housing half 22.

The ground bus plate 27 has end tabs 32 which extend between the end four sockets in the socket arrays, and those sockets are electrically connected to the plate tabs 32 by spot welds 33. The cable 12 is locked in the connector 11 by a rib 34 on the rear housing block 24 which forces the cable into a locking, U-shape fitted into a slot 35 in the lower housing half 22. The second cable 13 is similarly locked by a rib 36 on the upper housing half 21 forcing that cable into a slot 37 in the rear housing block 24.

In carrying out the invention, all of the plate members 25, 26, 27 are slotted, preferably by die cutting, to form slots 40 having a width somewhat narrower than one of the wires 15 with the slots 40 being in the three planes of the plate members 25, 26, 27 and also being spaced laterally at the spacing of the wires 15 in the cable 12. The cable wires 15 can thus be forced with downward progressive pressure longitudinally into respective ones of the slots 40 in the manner, and to produce the termination connection, disclosed in some detail in said U.S. Pat. No. 4,173,388. The wires need not be precisely fanned out, but rather the required spacing is done out of the plane of the cable 12 as a result of laying the wires 15 over the slots 40 and forcing them longitudinally into the slots. The term "slot" means either a depression or an aperture, so long as it has the stated configuration.

Figure 4:
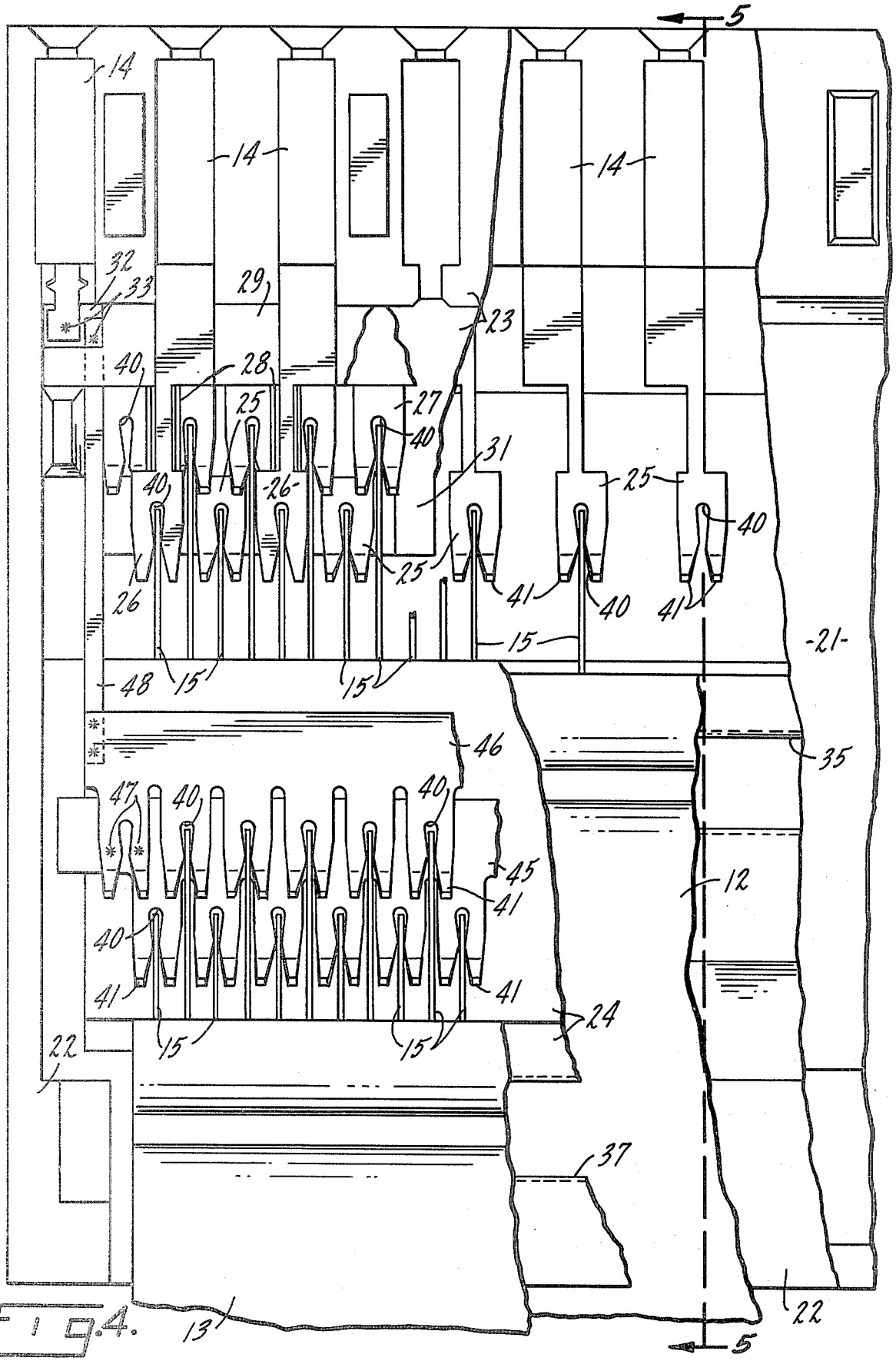
FIG. 4 is a greatly enlarged, fragmentary and partially broken away plan view of portions of the connector appearing in FIGS. 1 and 2.

As best seen in FIG. 4, the spacing between the axes of the adjacent sockets 14 need bear no relationship to the spacing between the axes of the slots 40. Socket spacing will be set by the disposition of the pins to which the connector is to be connected, but the slots 40 can be formed in the plate members 25, 26 to match the spacing of the signal wires in the particular cable being used.

As a feature of the invention, wire-slot engagement is facilitated by forming the slots 40 so that they include an outwardly tapered throat with those portions 41 defining the throat being bent from the plane of the plate members to form tapered wire guides for guiding movement of the wires 15 perpendicularly of the plate members into the slot 40. The bent throat portions are like ski tips, and insure proper wire-slot mating upon downward movement of the wire longitudinally into the slots. The plate members 26 of the upper row of sockets already engage the wires 15 at a fairly sharp angle so that the open throat of the slots 40 in these plate members themselves provide a good guide for the wire into the slots and the bent portions 41 are not required.

To terminate the second or ground cable 13, a pair of ground bus plate members 45 and 46, formed much like the ground bus plate member 27, are positioned within the connector 11 so that their slots 40 are staggered laterally and longitudinally, with the plate members being spot welded at 47 together. The combined plate members 45, 46 are disposed behind the first ground bus plate member 27 and over the first cable 12. Straps 48 at the ends of the bus plate members electrically connect the members 45, 46 to the member 27, and thus all wires of the second cable 13 are electrically connected to the four end ground sockets in the two socket arrays.

When a second ground cable 13 is desired, the wire ends of the cable 13 are stripped, the wires laid onto the ski tips formed by the bent throat portions 41 of the plates 45, 46, and downward progressive pressure on the wires makes the connection. After termination, the upper housing half 21 is positioned over the lower half and the housing is secured, preferably by sonic welding. If the second ground cable 13 is not desired, such a wire is simply not connected to the plate members 45, 46 and the housing halves 21, 22 are joined together containing only the cable 12. The same parts thus basically serve for either type of wire-connector assembly.

We claim:

1. A cable-connector assembly comprising, in combination, a housing, an upper and a lower array of pin sockets having plate members disposed in said housing, a ground bus plate member disposed in said housing intermediate said two arrays of sockets, a flat cable having a plurality of wires spaced in one plane, all of said plate members being slotted to a width somewhat narrower than the width of one of said wires, said slots being in the three planes of the socket plate members and the bus plate member and being spaced laterally at the spacing of the wires in the cable, the ends of said wires being forced longitudinally into respective ones of said slots, and means to lock said cable to said housing.

2. The combination of claim 1 in which a second cable is locked in said housing parallel to the first, a second ground bus plate member disposed behind said first bus plate member and over said first cable, the wires in said second cable being forced longitudinally into respective ones of slots in the second ground bus plate member, and means electrically coupling said first and second bus plate members.

* * * * *

UNITED STATES PATENT OFFICE

CERTIFICATE OF CORRECTION

Patent No. 4,225,207 Dated September 30, 1980

Inventor(s) Edward P. Brandeau and John M. Gentry

It is certified that error appears in the above-identified patent and that said Letters Patent are hereby corrected as shown below:

Column 1, line 19, change 5/8" to -- 1/8" --; and line 23, change 5/8" to -- 1/8" --.

Signed and Sealed this

*Ninth* Day of *December 1980*

[SEAL]

*Attest:*

SIDNEY A. DIAMOND

*Attesting Officer*

*Commissioner of Patents and Trademarks*